United States Patent [19]

DeClute

[11] Patent Number: 4,749,302

[45] Date of Patent: Jun. 7, 1988

[54] SPACING PAD

[76] Inventor: Robert G. DeClute, 174 Symons St., Toronto, Ontario, Canada, M8V1V2

[21] Appl. No.: 494,818

[22] Filed: May 16, 1983

[51] Int. Cl.[4] ..... E01C 5/20

[52] U.S. Cl. ..... 404/37; 404/41

[58] Field of Search ..... 404/43, 40, 41, 37; 52/126.5, 126.6, 385, 386, 98; 248/678, 679, 188.1, 188.2; 425/542; 264/328.12

[56] References Cited

U.S. PATENT DOCUMENTS

| | | | |
|---|---|---|---|
| D. 259,283 | 5/1981 | De Clute | D25/88 |
| 2,893,164 | 7/1959 | Martin | 248/188.2 |
| 3,096,695 | 7/1963 | Reinhardt | 404/43 |
| 3,676,971 | 7/1972 | Dombroski | 404/43 X |
| 3,861,098 | 1/1975 | Schaub | 52/98 |
| 3,873,225 | 3/1975 | Jakobsen et al. | 404/41 |
| 3,892,902 | 7/1975 | Ilukowicz | 52/173 X |
| 4,140,828 | 2/1979 | Copping | 264/328.12 X |
| 4,373,306 | 2/1983 | Rech | 52/98 |

FOREIGN PATENT DOCUMENTS

| | | | |
|---|---|---|---|
| 2360033 | 2/1978 | France | 248/188.2 |
| 267832 | 3/1927 | United Kingdom | 404/41 |

*Primary Examiner*—Jerome Massie
*Assistant Examiner*—Matthew Smith
*Attorney, Agent, or Firm*—James J. Ralabate

[57] ABSTRACT

The invention provides in the upper portion of the spacer pad spacer ribs 7. These ribs are notched in such a manner that they will lock with alignment ribs 10 that are provided in the bottom portion of each spacer pad. When the pads are stacked, lateral movement or shifting is prevented because alignment ribs 10 fit snugly into the notches 12 of spacer ribs 7 and provide a very stable support. This alignment and interlocking of alignment ribs 10 with spacer ribs 7 is a critical feature of this invention.

13 Claims, 3 Drawing Sheets

SPACING PAD

This invention relates to a device useful in the construction industry and more specifically for use in support of paving structures.

BACKGROUND OF THE INVENTION

It is known to use various paving slabs when constructing walkways over decks, podiums, terraces, pool decks, and roof promenades. Generally, precast concrete blocks are used and the conventional method is to set the blocks directly into sand, gravel, mortar beds, or onto the insulation or membranes positioned over a roof structure. This practice has been unacceptable because weather conditions can cause the blocks to dislocate or shift, thereby causing voids or even cracks in these structures. Additionally, water generally seeps below the blocks or slabs, and causes erosion of the sand or gravel support and the resulting shifting of the blocks. Water that enters below the block surface not only deteriorates the support layer, but also because of the freeze-thaw cycle, eventually damages the membranes and destroys their waterproofing capabilities. As a result of this support deterioration, many surfaces have to be uprooted and resurfaced or at least the blocks realigned. Repairs are frequent and costly, and replacing of membranes occurs often.

To correct this problem, various blocks or paver support systems similar to those disclosed in U.S. Pat. Nos. 3,861,098 and 3,892,902 have been introduced into the construction industry. Many of these new structures and, in particular, the pedestal defined in U.S. Pat. No. Des. 259,283 have been successful in reducing substantially the damage caused by the entry of surface water into these structures. Because the pedestal of this above-noted patent has an elevated support portion, walk deck surfaces can be elevated to provide a drain conduit between the blocks or pavers and the support surface covered by a waterproofing membrane. This pedestal comprises a gridlike structure of a high density polymeric material such as polyethylene having integral spacer ribs positioned on the upper surface of the pedestal. These spacer ribs guide and maintain in position the corner portions of a block or paving slab and provide spacing and cushioning between each block. The lower portion of the block then rests over the upper face or grid of the pedestal, permits any moisture to fall below the block and drain away without damaging the block or support surface. The pedestal, because it incorporates a unique through drainage and air-vent design, eliminates water entrapment and consequent damage to the corners of the paver slab or blocks.

Even as effective as the pedestal of U.S. Pat. No. Des. 259,283 has been, there are some structural improvements that need attention. This is especially apparent when these pedestals are stacked and some degree of lateral movement occurs. This lateral shifting or movement is very undesirable because when the units are multiple stacked in halves or quarter modules there is no interlocking of them to keep them together. Also they cannot property support loads and if shifting occurs, collapse of the structure results. In addition, because of the thickness of the material in the formed spacer rib, a substantial amount of shrinkage and distortion after molding could occur. This causes resulting pedestals of non-uniform configuration which is fatal when alignment and stacking are features necessary for proper usage. A further drawback in this pedestal configuration is the flashing or surface extension that is a result of the mold pressure needed to get proper cavity fill during the manufacturing operation. The flashing caused could seriously impede the water drainage feature of the pedestal.

Therefore, successful as this particular pedestal has been, it nonetheless can be substantially improved by structural improvements and modifications.

SUMMARY OF THE INVENTION

It is therefore an object of this invention to provide a paver support devoid of the above-noted disadvantages.

Another object of this invention is to provide a paver pedestal that will provide enhanced structural strength over those of the prior art.

Another still further object of this invention is to provide a paver pedestal that will be substantially free of flashing and will be generally of a uniform configuration.

Yet a further object of this invention is to provide a paver pedestal that minimizes or eliminates lateral movement when stacked with other pedestals.

Still yet a further object of this invention is to provide a paver pedestal that facilitates leveling and stabilizing of the final walk surface.

Another yet further object is to provide a pedestal having improved strength and substantially eliminates buckling or distortion during manufacturing.

Yet still another object is to provide a pedestal that facilitates proper nesting and alignment with the pedestal below, and thus stabilizes the stacked pedestals.

The foregoing objects and others are accomplished in accordance with this invention by providing an improved paver pedestal which comprises spacer rib projections having a vertically ridged configuration. In addition, the pedestal comprises alignment ribs of extended width that will mate with and lock with said ridged spacer rib. This alignment rib modification creates an interlocking with the spacer ribs when stacking is done using the full pedestal, half pedestal or when in used quadrants. This new configuration eliminates or minimizes any lateral movement of the pedestals. Together with the notched or ridged spacer rib and extended alignment rib, channeling is provided at the base portion of the pedestal to enhance both its strength and its ease of manufacture. This channeling runs diagonally across the base of each pedestal quadrant and strengthens the base portion against distortion or buckling. Together with the pedestal structure an apertured leveling plate is used to shim and thus compensate for minor deck and paver discrepancies.

DESCRIPTION OF THE DRAWING AND PREFERRED EMBODIMENTS

Figure 1:
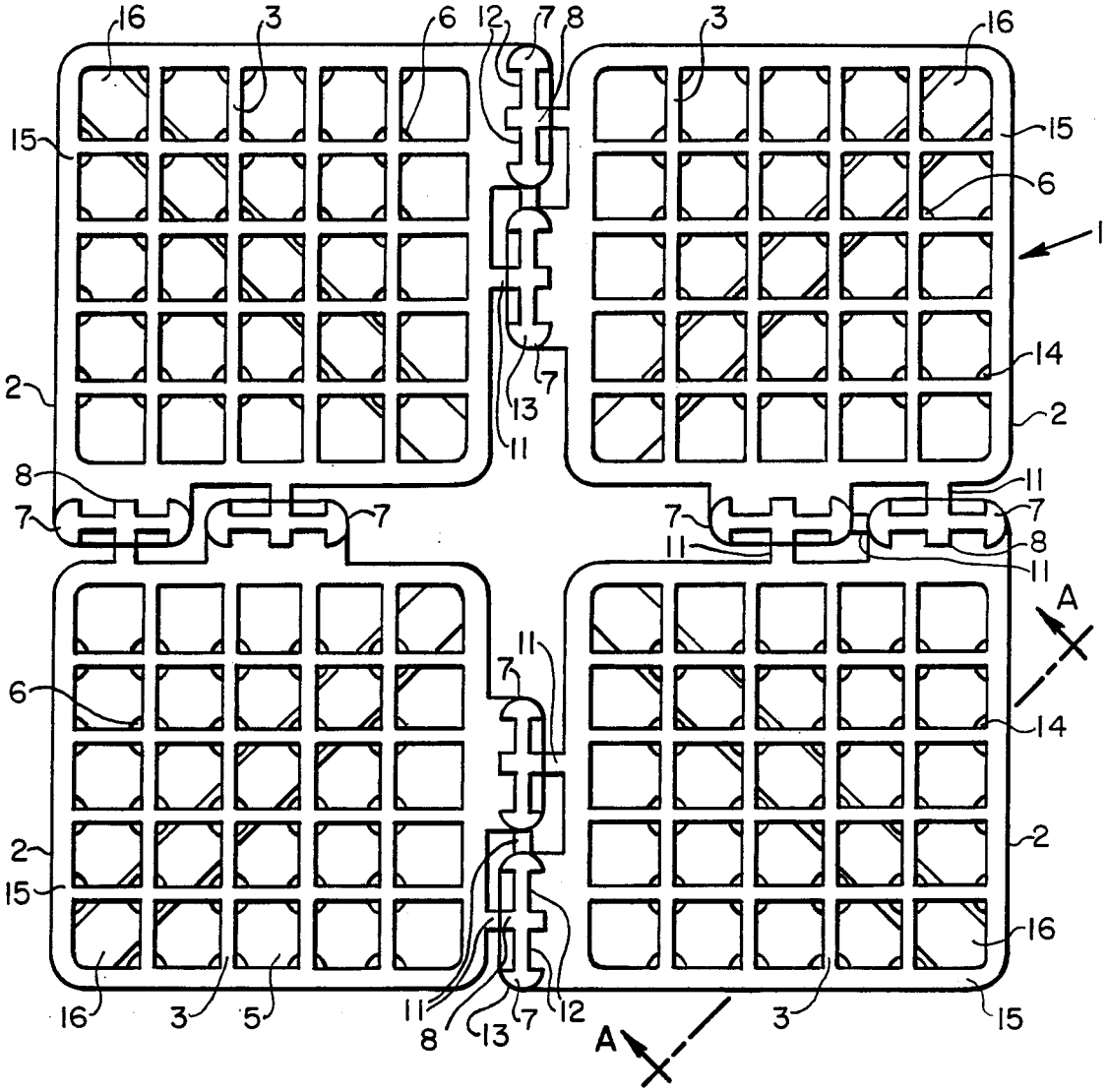
FIG. 1 is a top plan view of the spacing pad or pedestal of this invention.
Figure 2:
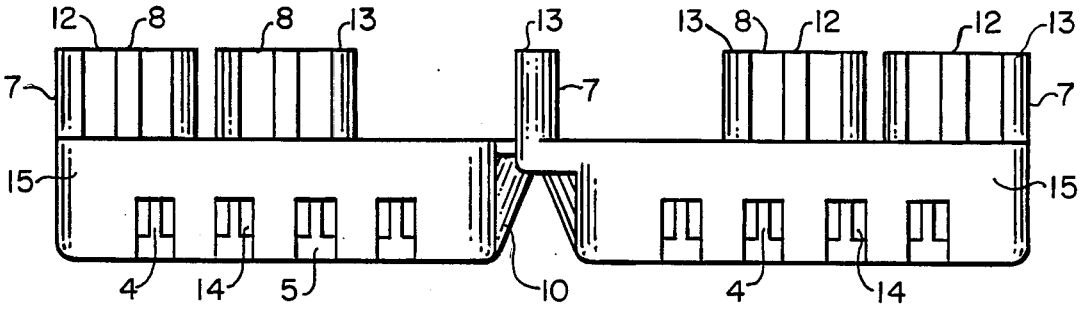
FIG. 2 is a side elevational view of the pedestal of this invention.

FIGS. 1 and 2 show pedestal 1 having four readily breakaway quadrants 2. Each quadrant 2 comprises a grid structure 3 having grid walls 4 extending vertically down to become integral with pedestal floor 5. Positioned uniformly in pedestal floor 5 are drain apertures 6 adapted to permit the flow of water and air and other liquids therethrough. While these apertures 6 allow water drainage they also facilitate the air drawn out from the tips of the paver stone. Located between each quadrant 2 and integral therewith are spacer ribs 7 having ridges or ribs 8 therein. These ridges 8 impart additional strength to the spacer ribs 7 and have a bonus manufacturing advantage. Without these ridges 8, there is shrinkage on the spacer rib 7 due to the thickness of the material. This causes a slow down during the molding operation to get proper cavity fill by the plastic flowing into the mold. In order to insure uniform flow into the cavity during manufacturing, additional flow pressure is exerted internally. While this accomplishes substantially uniform flow into the cavities, flashing is caused around the peripheral portions of the pedestal. Flashing is the excretion of plastic out of the mold cavity at the part line and causes an excess plastic formation along the edges of the product. This flashing could cause non-uniformity and distortion in the final product. To correct flow properties a ribbed or ridged wall is created in each spacer rib 7. This also minimizes rib shrinkage after the molding and cooling down period. It is extremely important that process perameters be controlled to avoid whenever possible any conditions that cause non-uniformity in the product. Also, ridged spacer ribs provide an excellent means for stabilizing the pedestal against lateral movement when in use. Spacer ribs interlock with alignment ribs 10 and prevent any side to side movement of the stacked pedestals. Alignment ribs 10 extend beyond the closest edge of spacer ribs 7 when viewed in side elevation. This feature is important to this invention since it is required for proper interlocking with the adjacent spacer rib 7 of the below stacked pedestal. This feature in alignment ribs 10 of extending beyond the closest edge of spacer rib 7 can be viewed in FIG. 2. Alignment rib 10 when stacked fits into and mates with recessed rib portion 12. The alignment rib 10 fits snuggly in recessed portion 12 and against rib 13. This alignment and interlocking of alignment rib 10 with spacer rib 7 is a critical feature of this invention. In order to accomplish this, alignment rib 10 must extend at least beyond the closest edge of the above stacked rib 7.

The pedestals 1 of this invention can be easily separated into halves or quarters to accomodate perimeter edge and corner support. Breakaway or frangible connections 11 provide an easy and convenient means for separating the pedestal 1 into two or four equal portions.

Side apertures 14 are co-extensive with the floor 5 of the pedestal 1 and the side portions 15 thereof. This feature provides thorough drainage out of the pedestal 1 and prevents water entrapment that may damage both the block or slab position thereon. The pedestals 1 have excellent weather-ability and may be made of any suitable material. Typical materials are plastics, synthetics, or other non-corrosion materials. It is preferred to use a high density poly-etheylene because of its inert properties to the elements. The paver pedestals 1 also provide even joint spacing of paver blocks or slabs and allows easy maintenance. The paver blocks simply lift out of position for access to substrate areas. In addition, it is convenient to replace damaged block simply by lifting it out and replacing it with another block. There is no special skill or tools needed to either install or maintain this structure.

Figure 3:
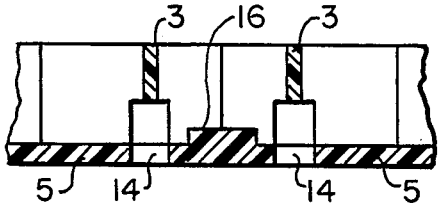
FIG. 3 is cutaway side view taken along line A—A of FIG. 1 and illustrating the raised flow channel of the pedestal of this invention.

Another important feature to this invention resides in locating a four flow channels 16 diagonally extending from one corner to the opposite corner of each quadrant 2. In FIG. 3 a cutaway view taken along line A—A of FIG. 1 shows the raised position of channel 16. Channel 16 is raised substantially above the plane of floor 5 and diagonally bisects each quadrant 2. The main advantages of the presence of channel 6 are to facilitate material flow during molding, reduce mold pressure requirements and thus minimizing flashing at part line. In addition, channel 16 stabilizes the configuration of pedestal 1 and minimizes the possibility of buckling or distortion.

Figure 4:
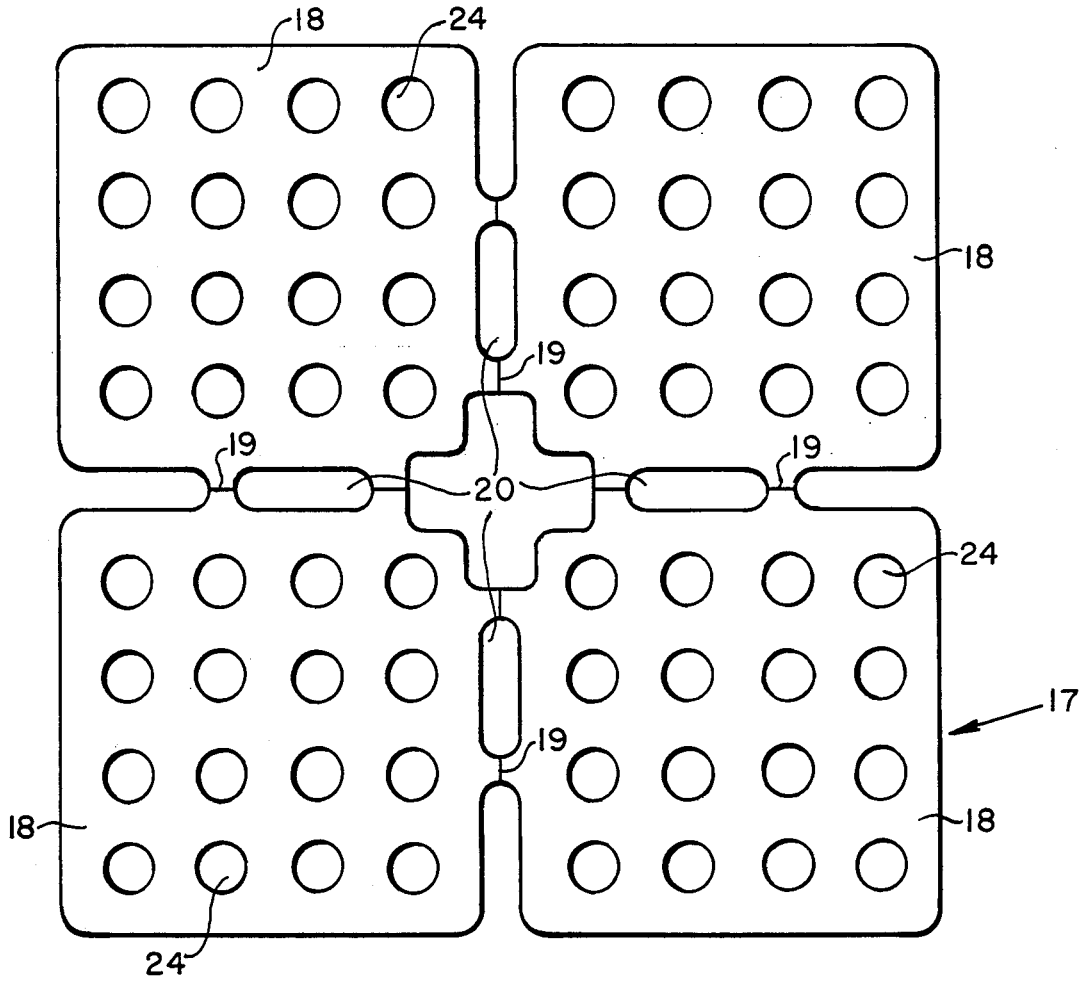
FIG. 4 is a top plan view of the leveling plate of this invention.

In FIG. 4, levelling plate 17 is illustrated. This plate comprises a main frame quadrant portion 18 that may be separated into two or four equal pieces when desired. Breakaway sections 19 provide a convenient and easy means to separate each quadrant one from the other. These plates 17 are used to fit over each pedestal 1 and mate directly with, below or in proximity with it. Apertures 24 allow water to pass therethrough and out of the apertures 6 and 14 to drainage. Portals 20 are adapted to fit over and around the general peripheral portions of spacer ribs 7. Levelling plates 17 compensate for uneveness of substrates or of paver blocks used with the pedestals 1. These plates 17 can be multiple stacked or stacked singly depending upon the surface uneveness to be overcome or corrected. The insertion of levelling quadrants 18 over pedestals 1 will surface align one paver block with the next and compensate for minor deck and paver block discrepancies. As noted above, levelling plates may be separated into halves or quarters by breaking at breakaway sections 19. Therefore, levelling of horizontal surfaces may be achieved by stacking pedestals 1 and levelling plates 17 to any feasible desired height. Also, if there is any variation in paver block thickness, the levelling plate 17 may be used to create a level upper surface. These plates 17 can also be used with or without the extra pedestals to achieve dead level paving over a sloping deck or roof surface. When multiple stacking of pedestals 1 are employed, the levelling plate 17 is located on top of the upper pedestal and never in between or below a pedestal.

Figure 5:
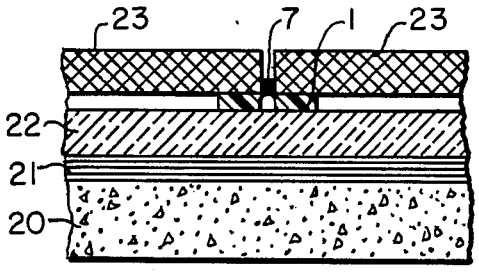
FIG. 5 is a schematic view of the pedestal of this invention when in use supporting a paver block.

In FIG. 5, the position of the pedestal 1 of this invention when in one specific use is depicted. A structural surface 20 such as a deck area, plaza, terrace, roof, or walkway has positioned thereover a waterproofing membrane 21. Above said membrane 21 is an insulation 22 of any non-water absorptive suitable material. Above said insulation 22 is pedestal 1 of this invention. The positioning of paver blocks or slabs 23 over said pedestal 1 is shown. Each pedestal has projecting upwardly therefrom the spacer ribs which provide a uniform separation between each paver block 23. The pedestal 1 of this invention can be used directly over any surface and the sequence of layers depicted in this FIG. 5 is for illustration only and not limitation. For example, it is not uncommon for the pedestal 1 to be used directly over a membrane or protection board or topping.

In FIG. 4 levelling plate 17 has breakaway portions 19 that preferably have a thickness somewhat less than the thickness of the remainder of plate 17. Each quadrant 18 of plate 17 may be used separately to enhance the levelling of substrates or paver blocks used with pedestals 1. The entire plate 17 may be used as a levelling device or any part of plate 17 may be used as a levelling means. The thickness of plate 17 can vary depending on the desired use. In most cases it will have a thickness that will permit easy breaking away of each quadrant 18.

Figure 6:
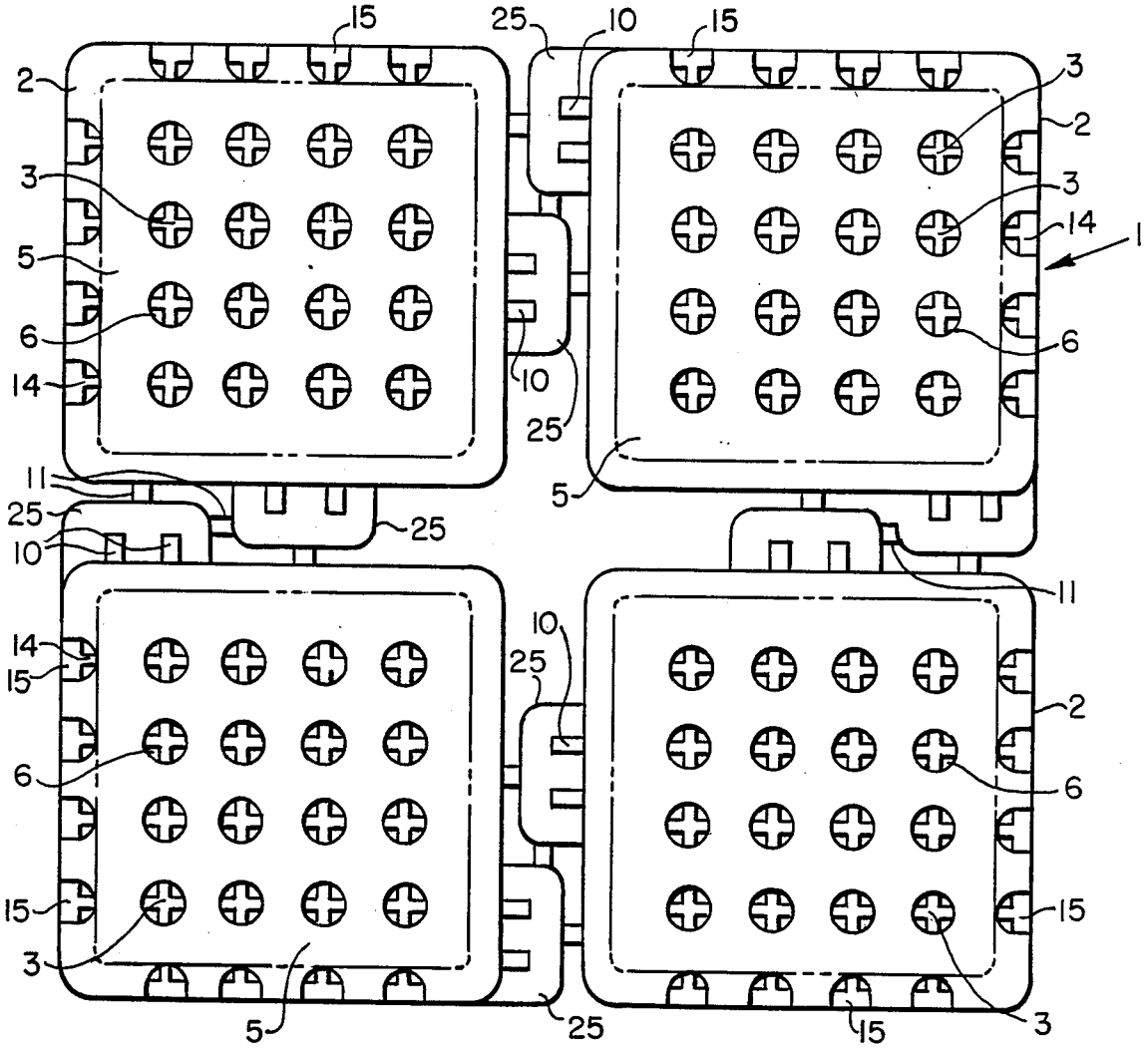
FIG. 6 is a bottom plan view of the spacing pad or pedestal of this invention.

FIG. 6 shows a bottom plan view of pedestal 1 having four breakaway quadrants 2. Each of said quadrants 2 has a grid structure 3 integral with pedestal floor 5. Located in floor 5 are drain apertures 6 positioned uniformly across the area of floor 5. Any suitable number of drain apertures 6 may be used, for illustrative purposes 16 apertures 6 are shown in each quadrant 2. Partial apertures or side apertures 14 are co-extensive with floor 5 and side portions 15 thereof. The side apertures 14 are uniformly positioned around the outside periphery of pedestal 1 and further facilitate the drainage of air, water or other liquids away from the interior of pedestal 1. Spacer ribs 7 cannot be seen in this FIG. 6 since they extend upwardly and are not visible in a bottom plan view of pedestal 1. They can be seen in relation to alignment ribs 10 in FIG. 2. In this FIG. 6, alignment ribs 10 can be seen as extending about halfway across the width of spacer rib base portion 25. This is a critical feature of the present invention. In order for appropriate interlocking with the adjacent spacer rib 7 of the below stacked pedestal, alignment ribs 10 must extend beyond the abutting or terminal portion of ridges 8 and lock into the recesses or openings between the ridges 8 of the spacer ribs 7.

The preferred pedestal 1 of this invention is made from a polymeric material having a low termperative brittleness of about −50° to −60° C., is UV stabilized, and has a shore hardness of about 65. Also, the preferred material for use in making this pedestal has a softening point of about 120° to 130° C. High density polyethylene is the material used that evidences optimum properties for use as a paver pedestal and for this reason is the preferred material.

The improved pedestal of this invention has been described specifically herein; however, any modifications or ramifications would be considered within the spirit of this invention.

I claim:

1. A spacing pad comprising a four breakaway quadrant structure, spacing ribs positioned intermediate each of said quadrants, and alignment ribs integral therewith, said quadrants connected by frangible means positioned adjacent each of said spacing ribs, each of said quadrants adapted to contain at least two spacing ribs after being separated one from each other, each of said quadrants comprising a quadrant floor with a grid structure extending upwardly therefrom, said floor containing drain apertures adjacent at least some of said upwardly extending grid structures, said apertures adapted to accomodate the flow of liquids therethrough, said floor having a raised channel extending diagonally from the center of said spacing pad to the opposite corner of each of said quadrants positioned immediately below said spacing ribs are said alignment ribs adapted to interlock and mate with said spacer ribs when at least a portion of said spacing pad is stacked with additional spacing pads having the identical configuration.

2. The spacing pad of claim 1 wherein said spacing ribs have a vertically ridged configuration comprising abutting portions and recessed portions, said alignment ribs adapted to fit into and mate with said recessed portions.

3. The spacing pad of claim 1 wherein each quadrant is separated one from the other by two spacing ribs, each spacing rib connected to the outer walls of two adjacent quadrants, one connection being by a frangible member, the other connection by a permanent non-frangible member.

4. The spacing pad of claim 1 wherein adjacent spacing ribs are connected to each other by a frangible member, and are connected to the outer wall of each quadrant by one frangible and one non-frangible member.

5. The spacing pad of claim 1 wherein said alignment ribs are substantially triangular shaped portions extending diagonally downwardly from approximately the middle of the bottom of the outer wall of said quadrants, each of said alignment ribs adapted to fit and lock into recesses located in each of the upwardly extending portions of said spacing ribs.

6. The spacing pad of claim 1 wherein each of said spacer ribs have at least two recessed portions.

7. A spacing pad comprising four quadrants, spacing ribs, alignment ribs, and a raised surface channel, each of said quadrants comprising a quadrant floor having upwardly extending walls forming a grid structure, said floor having apertures uniformly positioned therein to accommodate the flow of liquids therethrough, said spacing ribs located between each quadrant and at least one of said spacing ribs adapted to be frangibly separated from one of said quadrants, said alignment ribs extending downwardly from the base of said spacing ribs and connected at its lowest portion to a wall of said quadrant, said alignment ribs extending from approximately the midpoint of the base of said spacing ribs, said channel located in an elevated portion of said floor and extending diagonally across said floor.

8. The spacing pad of claim 7 wherein said quadrants are adapted to be easily separated one from the other.

9. The spacing pad of claim 7 wherein said spacing ribs have a vertically ridged configuration comprising abutting portions and recessed portions, said alignment ribs adapted to fit into and mate with said recessed portions.

10. The spacing pad of claim 7 wherein each quadrant is separated one from the other by two spacing ribs, each spacing rib connected to the outer walls of two adjacent quadrants, one connection being by a frangible member, the other connection by a permanent non-frangible member.

11. The spacing pad of claim 7 wherein adjacent spacing ribs are connected to each other by a frangible member, and are connected to the outer wall of each quadrant by one frangible and one non-frangible member.

12. The spacing pad of claim 7 wherein said alignment ribs are triangular shaped portions extending downwardly from approximately the middle of the bottom portion of said spacing ribs to the bottom of the outer wall of said quadrants, each of said alignment ribs adapted to fit into recesses located in each of the upwardly extending portions of said spacing ribs.

13. The spacing pad of claim 7 wherein each of said spacer ribs have at least two recessed portions.

* * * * *